US007878365B1

(12) United States Patent
Meehan

(10) Patent No.: US 7,878,365 B1
(45) Date of Patent: Feb. 1, 2011

(54) THEME MUG WITH TIMEPIECE

(75) Inventor: Brian G. Meehan, Fairfield, CT (US)

(73) Assignee: TimeMug LLC, Spring Valley, NY (US)

( * ) Notice: Subject to any disclaimer, the term of this patent is extended or adjusted under 35 U.S.C. 154(b) by 411 days.

(21) Appl. No.: 11/511,903

(22) Filed: Aug. 29, 2006

(51) Int. Cl.
*B65D 55/16* (2006.01)

(52) U.S. Cl. ..... 220/737; 215/6; 215/10; 215/12.1; 215/13.1; 220/62.12; 220/375; 220/495.03; 220/506; 220/592.16

(58) Field of Classification Search ..... 220/375, 220/506, 592.16, 592.17, 592.23, 592.26, 220/592.28, 713, 737; 215/2, 6, 10, 12.1, 215/13.1
See application file for complete search history.

(56) References Cited

U.S. PATENT DOCUMENTS

| | | | | |
|---|---|---|---|---|
| D65,799 | S | 10/1924 | Trombley | |
| D80,965 | S | 3/1930 | Brush | |
| 1,796,398 | A | 3/1931 | Richardson | |
| D94,618 | S | 2/1935 | Miedel | |
| 2,399,040 | A * | 4/1946 | Karle | 206/227 |
| D185,991 | S | 8/1959 | Loewy | |
| 3,972,443 | A | 8/1976 | Albert | |
| D253,214 | S | 10/1979 | Wilson | D7/535 |
| 4,293,015 | A * | 10/1981 | McGough | 220/739 |
| D314,308 | S | 2/1991 | Cogswell | |
| D314,689 | S | 2/1991 | Claudias | |
| 5,201,431 | A | 4/1993 | Berger et al. | |
| D337,056 | S | 7/1993 | Medina et al. | D10/22 |
| D349,244 | S | 8/1994 | Hersch | |
| 5,456,380 | A * | 10/1995 | Ito et al. | 220/713 |
| D365,523 | S | 12/1995 | Schena | |
| D370,851 | S | 6/1996 | Lage | D10/1 |
| D377,905 | S | 2/1997 | Lage | D10/6 |
| D382,173 | S | 8/1997 | Cogswell | |
| D384,860 | S | 10/1997 | Trombley | |
| D387,093 | S | 12/1997 | Liang | D19/85 |
| 5,839,599 | A * | 11/1998 | Lin | 220/62.12 |
| D442,030 | S | 5/2001 | Freed | |
| D443,796 | S | 6/2001 | Lin | D7/510 |
| RE37,773 | E | 7/2002 | Trombley | |
| D462,576 | S | 9/2002 | Janky | |
| 6,467,644 | B1 * | 10/2002 | Yeh | 220/592.17 |
| D471,764 | S | 3/2003 | Janky | D7/510 |
| D475,891 | S | 6/2003 | Bin | |
| D477,185 | S | 7/2003 | Janky | |

(Continued)

*Primary Examiner*—Anthony Stashick
*Assistant Examiner*—Elizabeth Volz
(74) *Attorney, Agent, or Firm*—Wood, Herron & Evans, LLP

(57) ABSTRACT

A mug (10) includes an outer transparent casing (40) having an open bottom end. A cup (11) is received in the casing (40). A display member (60) is positioned in a space (44) between the casing (40), and the cup (11) and images thereon can be seen through the casing (50). A threaded hub (16) is formed at the bottom of the cup (11), and a cap (64) engages the hub (16) to close the bottom of the casing (40). In this manner the cap (64) can be removed for access to the display member (60) should it be desired to change the display member (60). A timepiece (50) is carried by the casing (40) and a lid (20) may be attached to the cup (11). A cup (70) may be provided to engage the lower portion (43) of the casing (40) and to cover the cap (64).

23 Claims, 5 Drawing Sheets

U.S. PATENT DOCUMENTS

| | | | | |
|---|---|---|---|---|
| 6,588,593 | B2 | 7/2003 | Woskoski | |
| D482,933 | S | 12/2003 | Norris et al. | D7/510 |
| D484,743 | S | 1/2004 | Furlong | D7/510 |
| D486,996 | S | 2/2004 | Karp | D7/510 |
| D488,672 | S | 4/2004 | Oas | D7/507 |
| 6,747,918 | B2 | 6/2004 | Hight et al. | 368/10 |
| D493,667 | S | 8/2004 | Lipson | D7/515 |
| D494,010 | S | 8/2004 | Yuen | D7/511 |
| D523,692 | S | 6/2006 | Meehan | D7/507 |
| 2004/0035875 | A1* | 2/2004 | Pollack | 220/737 |

* cited by examiner

THEME MUG WITH TIMEPIECE

TECHNICAL FIELD

This invention relates to a beverage container mug such as would be used to hold coffee or the like. More particularly, this invention relates to such a mug which has a timepiece integrally associated therewith and which can be provided with a variety of decors to suit the desire of the user.

BACKGROUND ART

Beverage containers, such as coffee mugs or the like, which have a timepiece associated therewith are known in the art. These mugs are usually plain and unadorned, but they enable the user to conveniently observe the time of day. However, it is not known in the art to provide such a mug with the capability of being selectively adorned as may be desired by the user. Thus, a hunter or a soldier might like a mug with a camouflage pattern, a golfer might like a mug which carriers a picture of a golf hole, and the like. Or, a person may wish to periodically change the theme or adornment on his mug.

To date, there is no known mug which has the ability to allow the user to select a theme, design or pattern to be displayed on the body of the mug, and also such a mug which has the capability of displaying time.

DISCLOSURE OF THE INVENTION

It is thus an object of the present invention to provide a mug which can be provided with an adornment selected by the user.

It is another object of the present invention to provide a mug, as above, which is provided with an integral timepiece.

These and other objects of the present invention, as well as the advantages thereof over existing prior art forms, which will become apparent from the description to follow, are accomplished by the improvements hereinafter described and claimed.

In general, a mug made in accordance with one aspect of the present invention includes an outer transparent casing having an open bottom end. An inner cup is received in the casing and is spaced from the casing. A display member is positionable in the space between the casing and the inner cup. A threaded hub is formed on the bottom of the inner cup, and a cap has threads to engage the threaded hub and to close the bottom of the casing.

In accordance with another aspect of the invention, a mug has a transparent casing and a display member positioned adjacent to the casing providing indicia viewable through the casing, the display member being replaceable by the user. A timepiece is carried by the casing.

A preferred exemplary mug according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 5:
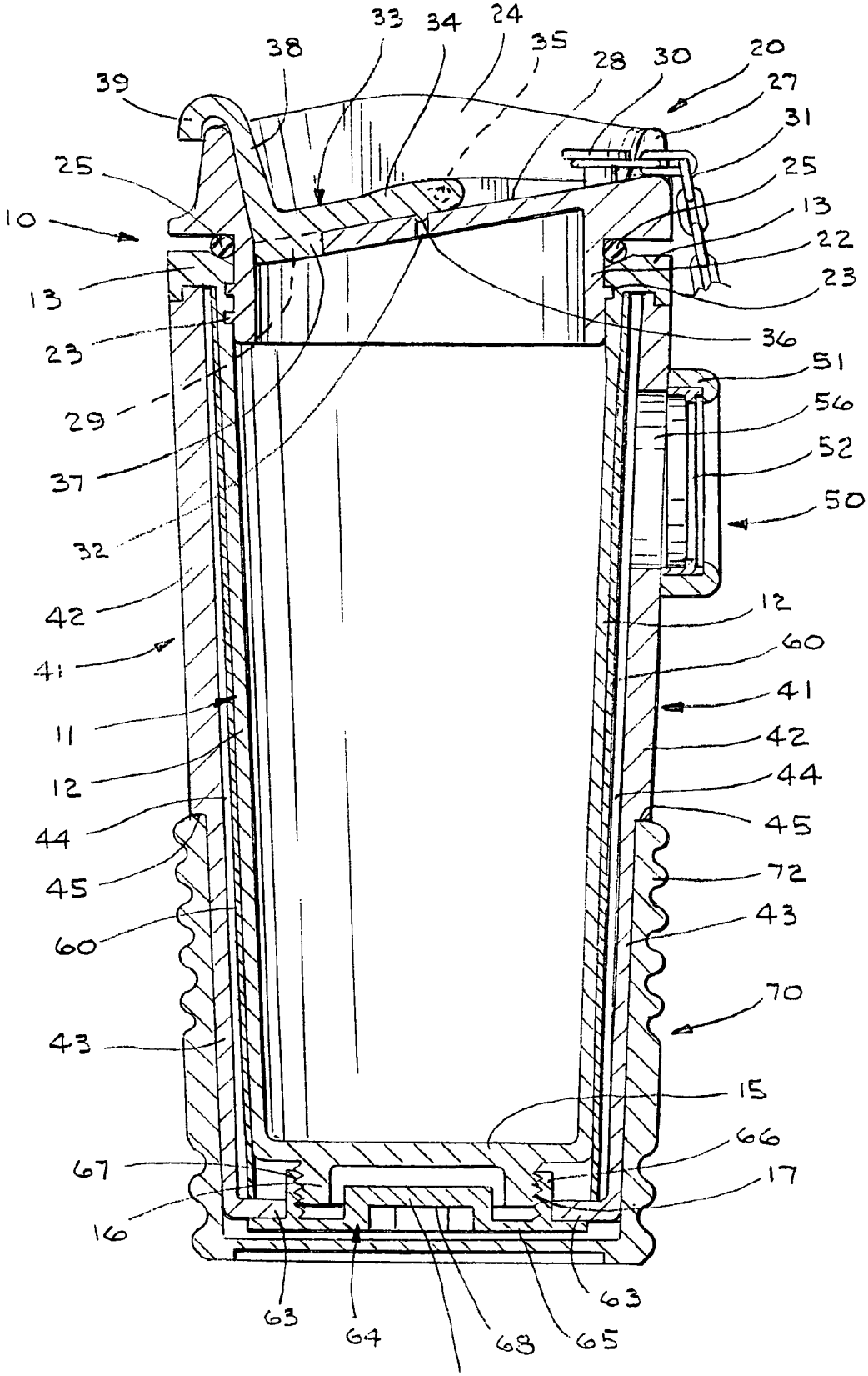
FIG. 5 is a sectional view taken substantially along line 5-5 of FIG. 2.
Figure 6:
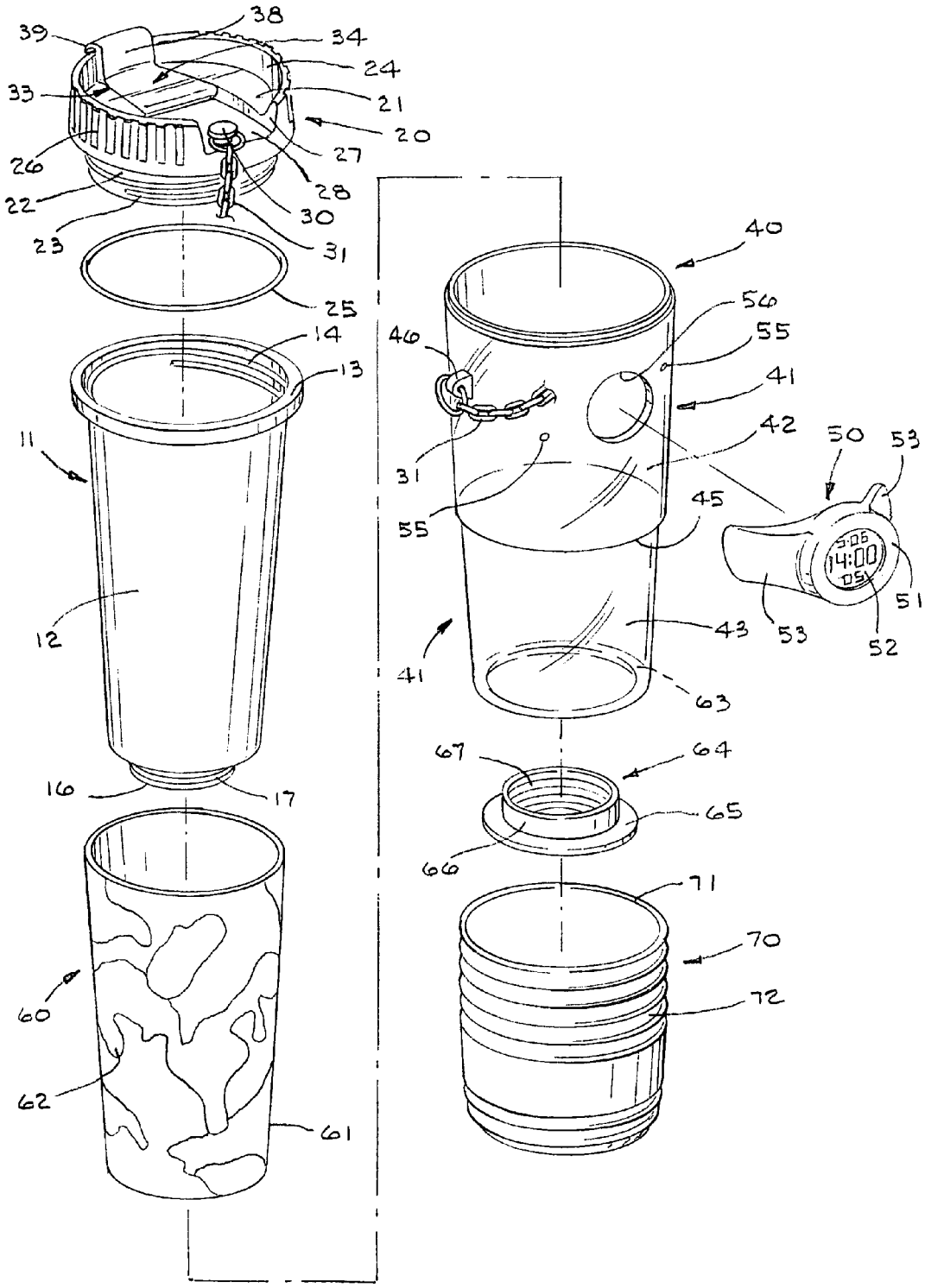
FIG. 6 is an exploded, perspective view of the components of a mug made in accordance with the present invention.

A mug made in accordance with the concepts of the present invention is generally indicated by the numeral 10. Mug 10 includes an inner cup, generally indicated by the numeral 11, which has an open upper end and is adapted to receive the liquid material, such as coffee, to be consumed by the user. Cup 11 can be made of a rigid impact plastic material such as SAN plastic, ABS or polycarbonate, and includes a generally cylindrical sidewall 12 which may be somewhat tapered inwardly as it extends downwardly, as shown in FIGS. 5 and 6. An enlarged peripheral lip 13 is formed at the top of sidewall 12 around the open upper end. Interior threads 14 are formed at the top of the inside of sidewall 12 at the area of lip 13. A bottom surface 15 closes the bottom of cup 11 and carries a circular hub 16 having external threads 17 as will be more fully discussed hereinafter.

Mug 10 can include a lid generally indicated by the numeral 20. Lid 20 can be of a conventional configuration but is shown as having a cover surface 21 having a circular skirt 22 with external threads 23 extending downwardly therefrom, and a gripping skirt 24 extending upwardly therefrom. Threads 23 of lid 20 are adapted to engage threads 14 of cup 11 to attach lid 20 to cup 11. An O-ring 25 may be received around skirt 22 above threads 23, and when the lid 20 is attached to cup 11, O-ring 25 may rest on the top of lip 13 of cup 11, as shown in FIG. 5, to seal lid 20 to cup 11. Skirt 24 may be provided with a plurality of external ribs 26 which not only enhance the ability to grip and turn lid 20 when tightening threads 23 on threads 14, but also provide an aesthetic feature to lid 20.

Skirt 24 is shown as being circumferentially interrupted, as at 27, and a recess 28 is formed in cover surface 21 at that location. Recess 28 extends diametrically across lid 20 and is sloped downwardly toward a drink opening 29 (FIG. 5) at one end of recess 27 through which the liquid in the mug 10 may pass even when lid 20 is closing cup 11. The other, upper end of recess 28 may include a pin 30 to which one end of a chain 31 is swivelably attached. As will hereinafter be described in more detail, chain 31 assures that lid 20 is carried by mug 10 when it is removed from the threaded engagement previously described. A small air vent 32 can be provided generally centrally in recess 28 which permits easier flow of the liquid in cup 11 through drink opening 29.

Lid 20 includes a cover, generally indicated by the numeral 33, which can be formed of plastic or neoprene. Cover 33 includes a base portion 34 which is pivotally carried, as at 35 (FIG. 5), by lid 20. Base portion 34 can thus be pivoted in recess 28 to a position in the end of recess 28 over pin 30. In this position, drink opening 29 and air vent 32 are open such that liquid can conveniently pass through opening 29. The underside of base portion 34 includes a plug 36 and a stopper 37. When cover 33 is pivoted so that base portion 34 is in the other end of recess 28, stopper 27 closes opening 29 and plug 36 closes air vent 32, as shown in FIG. 5. Cover 33 also includes a tab 38 extending upwardly from base portion 34. A hook 39 is formed at the end of tab 38 and can engage the top of skirt 24 when cover 33 is closing opening 29. To open lid 20, the user need only grasp hook 39 and pivot cover 33 from the position shown in the drawings to a position over pin 30, as previously described.

Mug 10 includes an outer casing, generally indicated by the numeral 40, which can be formed of a transparent plastic material, such as SAN plastic, ABS or polycarbonate. Casing 40 includes a generally cylindrical sidewall, generally indicated by the numeral 41, having an upper portion 42 with an open upper end, and a lower portion 43 having an open lower end. It should be noted that both portions 42 and 43 taper inwardly as they extend downwardly, and as such, the overall configuration of sidewall 41 matches that of sidewall 12 of cup 11. However, sidewall 41 is of a slightly larger diameter than sidewall 12 so that cup 11 may be received in casing 40. As best shown in FIG. 5, when so positioned, the upper edge of casing 40 is received beneath lip 13 of cup 11, and a small cylindrical space 44 is formed between cup 11 and casing 40. It should also be noted that upper portion 42 is of a slightly larger diameter than lower portion 43 of sidewall 41 thereby forming a step 45 at the transition point between them.

Upper sidewall portion 42 may be provided with a tab 46 to which the other end of chain 31 may be attached. Thus, as previously described, when lid 20 is removed to fully open mug 10, it remains carried by mug 10 in view of the chain attachment.

Figure 4:
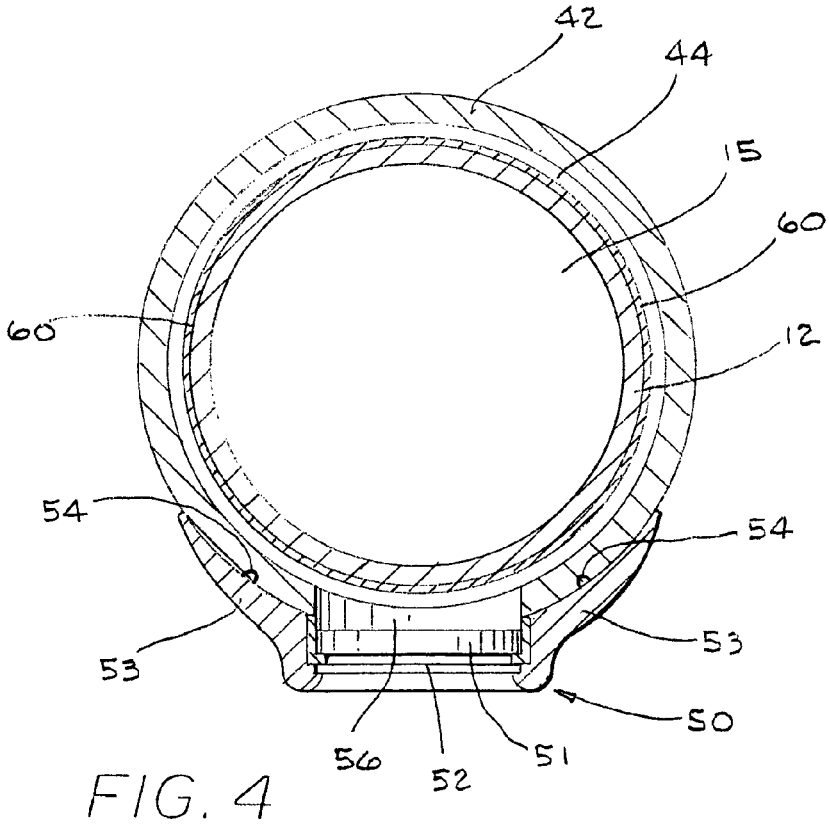
FIG. 4 is a sectional view taken substantially along line 4-4 of FIG. 2.

Upper sidewall portion 42 is also shown as carrying a timepiece generally indicated by the numeral 50. Timepiece 50 may include a conventional clock 51 having a face 52 which can display the time of day and/or other information. Timepiece 50 may also include a simulated watch band 53 to enhance the realistic nature of the timepiece, rendering its appearance as being much like a wrist watch. Band 53 may carry a small lug 54 (FIG. 4) on each side of clock 51 which may be snapped into apertures 55 formed in upper sidewall portion 42 of casing 40 to attach timepiece 50 to sidewall portion 42. In the event that timepiece 50 would need to be removed from casing 40 for repair, replacement, or the like, an aperture 56 is provided in sidewall portion 42 to gain access to clock 51 or to otherwise enable one to push on timepiece 50 to separate it from sidewall portion 42. As best shown in FIG. 5, a display member, generally indicated by the numeral 60, is received in the space 44 between the outer casing 40 and the cup 11. Display member 60 is shown as being in the form of a cylindrical sleeve, and its outer surface 61 is designed to provide a theme and other indicia for mug 10. It may be made of paper, cardboard, fabric, or the like as long as at least its outer surface 61 is capable of carrying some sort of indicia.

Thus, the outer surface 61 shown is provided with a camouflage pattern 62 to give mug 10 a hunting or military theme. It should be noted that consistent with this particular theme, clock 51 may display military time. Because display member 60 is removable, as now will be described, mug 10 can take on any theme desired by the user. For example, display member 60 could take on the form of one's favorite picture, or depict one's hobby so that, for example, a mother's mug could depict her children, a grandmother's mug could depict her grandchildren, or a golfer's mug could depict a golf scene.

To assemble mug 10, display member 60 may be received around sidewall 12 of cup 11, and then cup 11 and display member 60 may be inserted into outer casing 40. Display member 60 is prevented from falling out of casing 40 by a ledge 63 which is formed around the periphery of the bottom open end of lower sidewall portion 43. Then a cap, generally indicated by the numeral 64, may be utilized to close the bottom of casing 40. Cap 64 includes a circular head 65 which carries a collar 66 having internal threads 67. Threads 67 are adapted to engage threads 17 formed at the bottom of cup 11 which, when tightened, fully assembles mug 10 with the display member maintained therein. A hex-shaped opening 68 (FIG. 5) may be positioned in head 65 so that by engagement with a tool, such as an allen wrench, the cap 64 may be easily tightened or loosened.

If desired, a cup, generally indicated by the numeral 70, may be received around lower portion 43 of sidewall 41 of casing 40 to cover cap 64. When so positioned, the upper lip 71 of cup 70 rests against step 45 of sidewall 41 of casing 40, and cup 70 is maintained thereon by a friction fit. Cup 70 may be adorned with ribbing 72 or the like, which not only adds to the aesthetics of mug 10, but also provides a gripping area for the user when it is desired to overcome the friction fit and remove cup 70. When so removed, cup 70 can provide an additional drinking vessel, if desired.

It should be noted that, as shown, cup 70 covers the transparent lower sidewall portion 43 of casing 40, and thus, any portion of display member 60 exposed through lower sidewall portion 43 would be covered. However, if the depiction of the lower portion of display member 60 were important, mug 10 could be utilized without cup 20, or a display member 60 having indicia showing through only the transparent upper sidewall portion 42 of casing 40 could be utilized. Also, conveniently, one display member 60 could actually carry two displays. That is, a first display might normally be seen through upper sidewall portion 42, and a second display, which would normally, otherwise be seen through lower sidewall portion 43, is covered by the cup 70.

But to quickly change the theme, mug 10 could be disassembled and the display member 60 inserted in the other direction so that the second display is now observable through the transparent upper sidewall portion 42. Such disassembly, to replace or change display member 60, can quickly be accomplished by removing cup 70 and loosening cap 64 for access to display member 60.

In view of the foregoing, it should be evident that a mug constructed as described accomplishes the objects of the present invention and otherwise herein substantially improves the art.

What is claimed is:

1. A mug comprising an outer casing having an open bottom end, an inner cup having an open upper end, a closed bottom end and a threaded portion adjacent said closed bottom end, said inner cup being received in said casing and spaced from said casing, and a cap having a threaded portion to engage said threaded portion adjacent said closed bottom end of said inner cup, with said threaded portion of said cap extending through said open bottom end of said outer casing and being positioned between said outer casing and said threaded portion adjacent said closed bottom end of said inner cup, so that said cap closes said open bottom end of said casing.

2. The mug of claim 1, wherein a display member depicts a camouflage pattern viewable through said casing.

3. The mug of claim 1 further comprising a timepiece carried by said casing.

4. The mug of claim 3, further comprising apertures in said casing, said timepiece including lugs received in said apertures to attach said timepiece to said casing.

5. The mug of claim 3 wherein said timepiece includes a clock and further comprising an aperture in said casing to provide access to said clock.

6. The mug of claim 1 further comprising a drinking vessel removably received around the bottom of said casing, said drinking vessel thereby covering said cap.

7. The mug of claim 6 wherein said casing has an upper portion of a larger diameter than a lower portion, said drinking vessel being received on said lower portion.

8. The mug of claim 1 further comprising a lid received on said inner cup.

9. The mug of claim 8, said lid having a thread, said inner cup having a thread adjacent said open upper end to engage said thread of said lid to hold said lid on said inner cup.

10. The mug of claim 8 further comprising a chain connecting said lid to said casing.

11. The mug of claim 10 further comprising a pin carried by said lid and a tab carried by said casing, one end of said chain being connected to said tab and the other end of said chain being swivelably connected to said pin.

12. The mug of claim 8 further comprising a drink opening in said lid and a cover to selectively open and close said drink opening.

13. The mug of claim 12 wherein said cover includes a plug and is pivotable from a first position wherein said plug is in said drink opening, to a second position wherein said drink opening is open.

14. The mug of claim 13, said cover including a hook to engage said lid when in said first position.

15. The mug of claim 1 wherein said threaded portion of said inner cup is provided on a hub extending downwardly adjacent said closed bottom end of said inner cup and having a thread thereon.

16. The mug of claim 15 wherein said cap includes a head covering said open bottom end of said casing and said threaded portion of said cap is provided on a collar having a thread thereon to engage said threaded hub.

17. The mug of claim 1 wherein said outer casing is transparent.

18. The mug of claim 17 further comprising a display member positioned in a space between said casing and said inner cup.

19. A mug comprising an outer transparent casing having an open bottom end, an inner cup having an open upper end, a closed bottom end and a threaded portion adjacent said closed bottom end, said inner cup being received in said casing and spaced from said casing, a display member positioned in a space between said inner cup and said casing and having indicia viewable through said casing, a cap having a threaded portion to engage said threaded portion adjacent said closed bottom end of said inner cup, with said threaded portion of said cap extending through said open bottom end of said outer casing and being positioned between said outer casing and said threaded portion adjacent said closed bottom end of said inner cup, so that said cap closes said open bottom end of said casing, and a timepiece carried by said casing.

20. The mug of claim 19 further comprising a lid received on said inner cup.

21. The mug of claim 19 further a drinking vessel removably received around the bottom of said casing, said drinking vessel thereby covering said cap.

22. The mug of claim 19 wherein said threaded portion of said inner cup is provided on a hub extending downwardly adjacent said closed bottom end of said inner cup and having a thread thereon.

23. The mug of claim 22 wherein said cap includes a head covering said open bottom end of said casing and said threaded portion of said cap is provided on a collar having a thread thereon to engage said threaded hub.

* * * * *

UNITED STATES PATENT AND TRADEMARK OFFICE

CERTIFICATE OF CORRECTION

Figure 1:
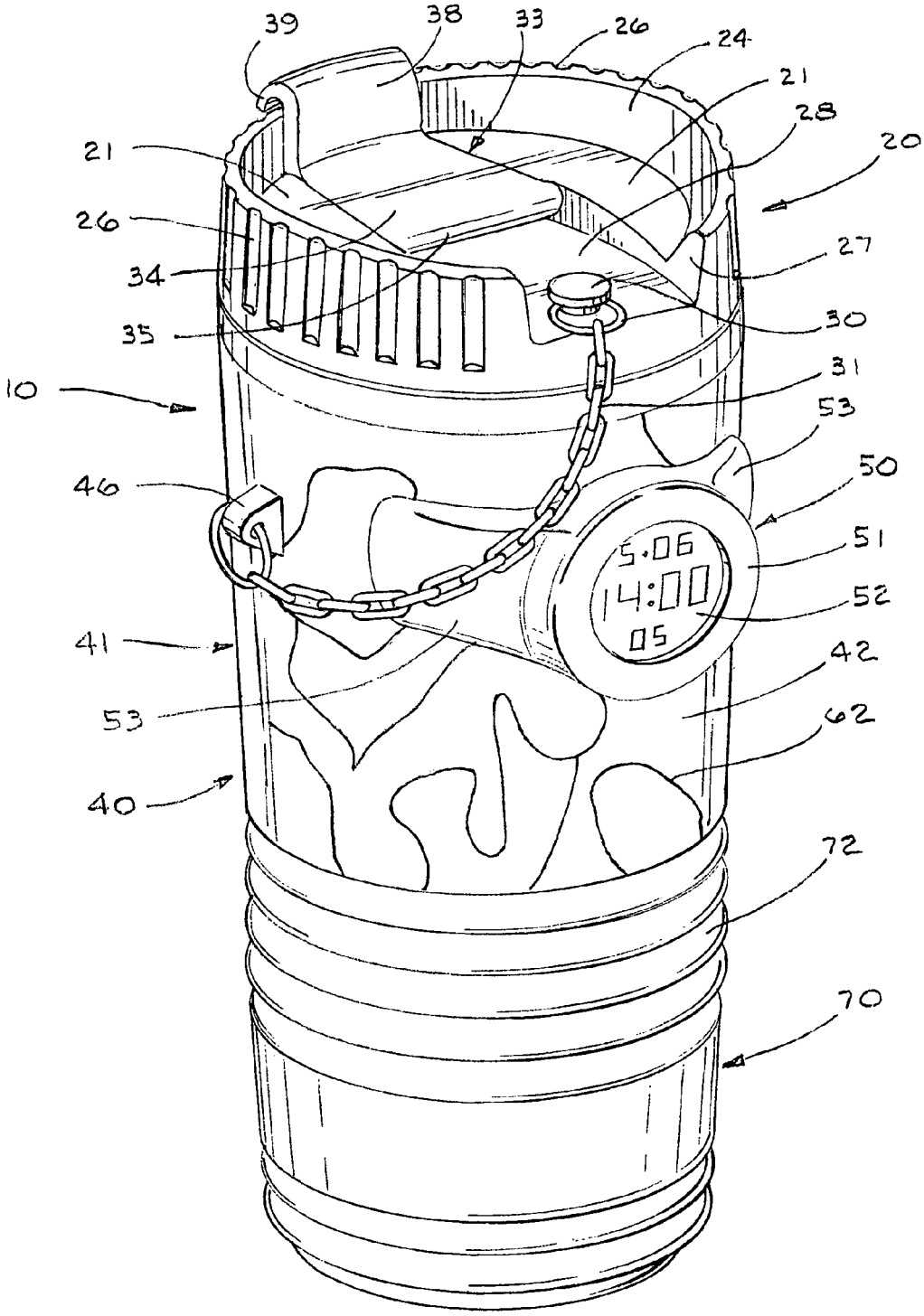
FIG. 1 is perspective view of a mug made in accordance with the present invention and shown with a camouflage adornment.
Figure 2:
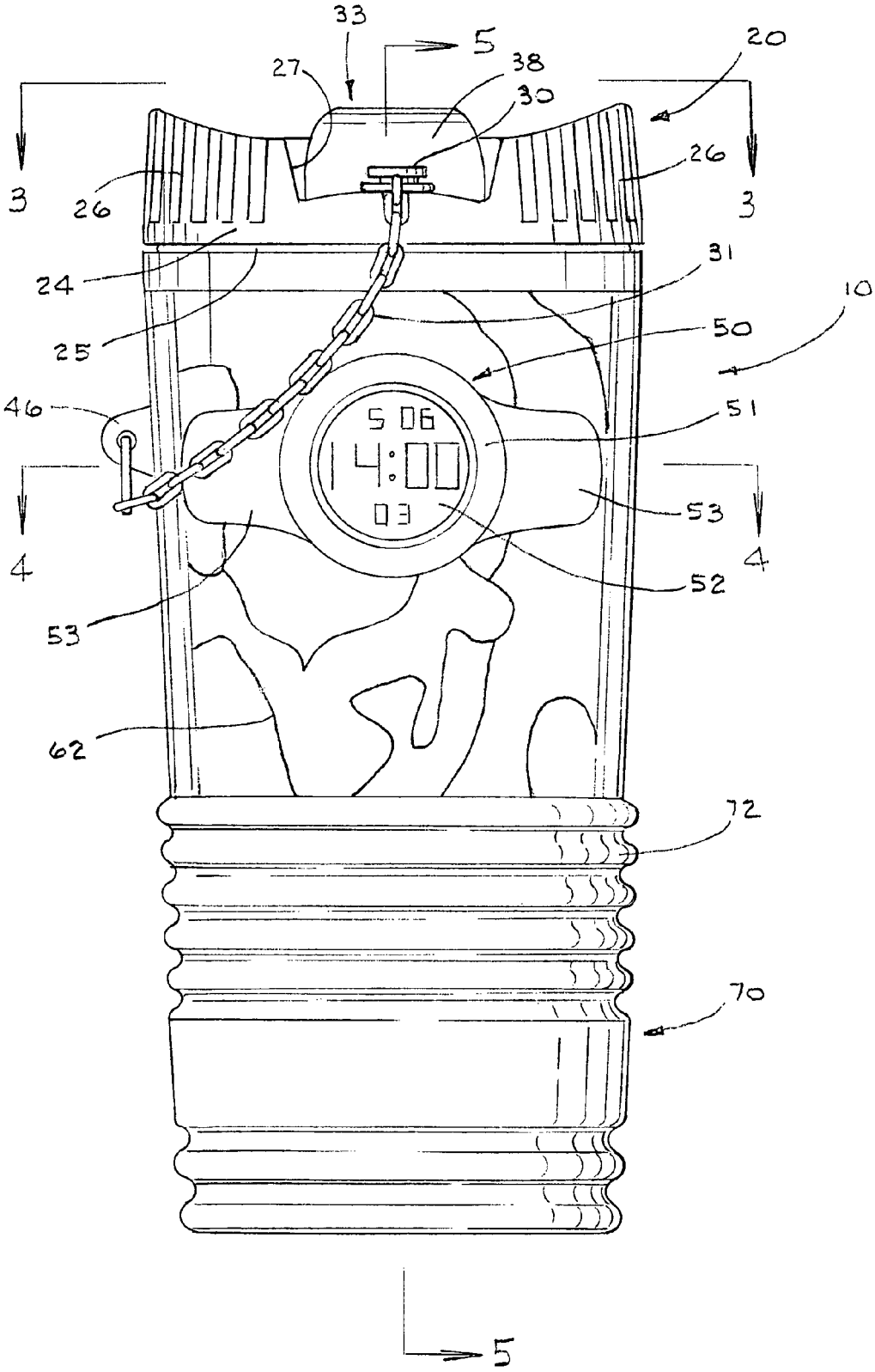
FIG. 2 is a front elevational view thereof.
Figure 3:
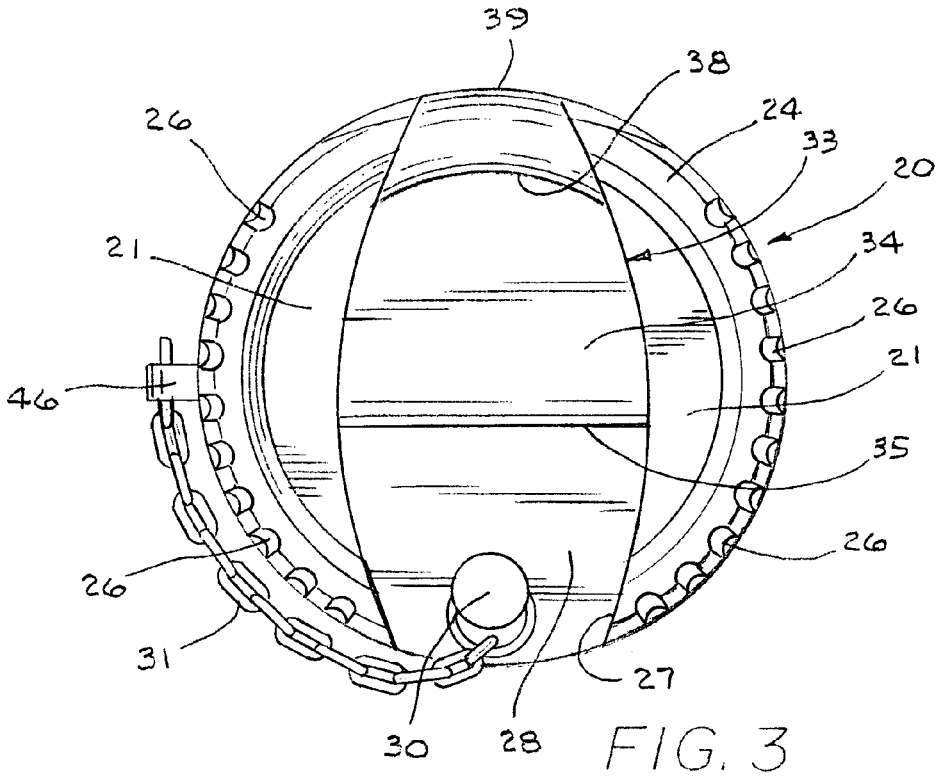
FIG. 3 is a top plan view thereof taken substantially along line 3-3 of FIG. 2.

PATENT NO. : 7,878,365 B2
APPLICATION NO. : 11/511903
DATED : February 1, 2011
INVENTOR(S) : Brian G. Meehan It is certified that error appears in the above-identified patent and that said Letters Patent is hereby corrected as shown below:

In column 1, line 62, change "FIG. 1 is perspective view" to --FIG. 1 is a perspective view--.

In column 3, line 40, "As best shown in FIG. 5, a display member, generally indicated by the numeral 60, is received in the space 44 between the outer casing 40 and the cup 11." should start as a new paragraph, as appears in the Specification at Page 5, line 5.

In column 3, line 49, "Thus, the outer surface 61 shown is provided with a camouflage pattern 62 to give mug 10 a hunting or military theme." should not start as a new paragraph, as appears in the Specification at Page 5, line 11.

In column 4, line 30, "But to quickly change the theme, mug 10 could be disassembled and the display member 60 inserted in the other direction so that the second display is now observable through the transparent upper sidewall portion 42." should not start as a new paragraph, as appears in the Specification at Page 6, line 16.

In claim 21, column 6, line 20, change "The mug of claim 19 further a drinking vessel" to --The mug of claim 19 further comprising a drinking vessel--.

Signed and Sealed this
Tenth Day of May, 2011

David J. Kappos

David J. Kappos
*Director of the United States Patent and Trademark Office*